United States Patent [19]

Tuttle

[11] 4,241,672

[45] Dec. 30, 1980

[54] METHOD OF REGULATING THE AMOUNT OF UNDERFIRE AIR FOR COMBUSTION OF WOOD FUELS IN SPREADER-STROKE BOILERS

[75] Inventor: Kenneth L. Tuttle, Federal Way, Wash.

[73] Assignee: The United States of America as represented by the United States Department of Energy, Washington, D.C.

[21] Appl. No.: 966,523

[22] Filed: Dec. 4, 1978

[51] Int. Cl.[3] ..... F23G 5/02

[52] U.S. Cl. ..... 110/346; 110/101 R; 110/187; 110/212; 110/245

[58] Field of Search ..... 110/101 R, 101 A, 101 CA, 110/101 CD, 347, 245, 212, 187, 346

[56] References Cited

U.S. PATENT DOCUMENTS

| | | | |
|---|---|---|---|
| 1,757,401 | 5/1930 | Thomas | 110/101 R |
| 1,831,912 | 11/1931 | Hoffman | 110/101 A |
| 1,970,523 | 8/1934 | Hoffman | 110/101 A |
| 3,190,245 | 6/1965 | Huntington | 110/101 |
| 3,605,655 | 9/1971 | Warshawsky et al. | 110/245 |
| 3,680,500 | 8/1972 | Pryor | 110/212 |
| 3,780,676 | 12/1973 | Hazzand et al. | 110/212 |
| 3,792,671 | 2/1974 | Woods | 110/346 |
| 3,822,657 | 7/1974 | Midkiff | 110/101 CD |
| 3,847,092 | 11/1974 | Gilbert | 110/101 R |
| 3,855,950 | 12/1974 | Hughes et al. | 110/212 |
| 3,888,194 | 6/1975 | Kishigami et al. | 110/245 |
| 4,013,023 | 3/1977 | Lombana et al. | 110/187 |
| 4,102,277 | 7/1978 | Wall | 110/245 |

*Primary Examiner*—Henry C. Yuen

*Attorney, Agent, or Firm*—James E. Denny; Dean E. Carlson; Richard E. Constant

[57] ABSTRACT

A method of metering underfire air for increasing efficiency and reducing particulate emissions from wood-fire, spreader-stoker boilers is disclosed. A portion of the combustion air, approximately one pound of air per pound of wood, is fed through the grate into the fuel bed, while the remainder of the combustion air is distributed above the fuel in the furnace, and the fuel bed is maintained at a depth sufficient to consume all oxygen admitted under fire and to insure a continuous layer of fresh fuel thereover to entrap charred particles inside the fuel bed.

1 Claim, 4 Drawing Figures

METHOD OF REGULATING THE AMOUNT OF UNDERFIRE AIR FOR COMBUSTION OF WOOD FUELS IN SPREADER-STROKE BOILERS

BACKGROUND OF INVENTION

As the use of various energy sources increase, there are increasing demands to obtain energy from renewable resources, and particularly from renewable resource scraps or residues thereof. One such energy source which is receiving increasing attention is the burning of wood and particularly wood residues, i.e., bark and wood scraps remaining from wood processing or forest wastes, to produce steam in boilers for process heat in factories, for space heating, and for generation of electricity.

Wood residue fuels are characterized by having a relatively high percentage of volatile matter, ranging from approximately 75% to 80% volatiles by weight, and often a relatively high moisture content, ranging from about 5 to 65% by weight. In addition, wood residues include less solid carbon per pound of fuel than coal.

The conventional methods of direct combustion of wood residue fuels for industrial use have utilized either the Dutch oven type of design, a suspension burning design or a spreader-stoker design. Of these designs the major portion of newly constructed boilers are of the spreader-stroker configuration. Presently operating wood residue spreader-stoker boilers, which generally use a fuel bed depth of about 1 inch or less and about 6 or 7 pounds or underfire air per pound of fuel, have been troubled by relatively high emissions of ash and unburned char which is carried out of the combustion chamber. High particulate carryover rates generally result in difficulties in meeting emission standards unless extensive pollution control devices are connected to the boilers. Further, the high carbon carryover rates result in decreased combustion efficiency since the fuel value of the carbon is not utilized in the boiler or furnace.

The burning of wood residue fuels in such furnaces or boilers have required rather elaborate and expensive particulate collection systems to meet emission standards for continued operation. The collection system costs are normally a large portion of the capital costs in building one of these energy source systems. The economics of burning of wood residue fuels may thus be governed by the cost of emission cleanup equipment.

SUMMARY OF INVENTION

In view of the above, it is an object of this invention to provide a method of controlling combustion air flow to more efficiently burn wood or wood residue fuels.

It is a further object of this invention to provide a method for controlling combustion air flow to reduce particulate emission from wood residue fired furnaces.

It is a still further object of this invention to provide a method of firing a wood residue fired furnace which provides more complete combustion of the fuel with a concurrent reduction in particulate emissions.

Various other objects and advantages will appear from the following description of the invention, and the most novel features will be particularly pointed out hereafter in connection with the appended claims. It will be understood that various changes in the details, materials, and arrangements of the parts, which are herein described and illustrated in order to explain the nature of the invention, may be made by those skilled in the art.

A method of metering underfire air for increasing efficiency and reducing particulate emissions from wood-fired, spreader-stoker boilers wherein a portion of the combustion air, approximately one pound of air per pound of wood, is fed through the grate into the fuel bed, while the remainder of the combustion air is distributed above the fuel in the furnace, and the fuel bed is maintained at a depth sufficient to consume all oxygen admitted under fire and to insure a continuous layer of fresh fuel thereover to entrap charred particles inside the fuel bed.

DESCRIPTION OF DRAWING

The invention is illustrated in the accompanying drawing in which.

DETAILED DESCRIPTION

Figure 1:
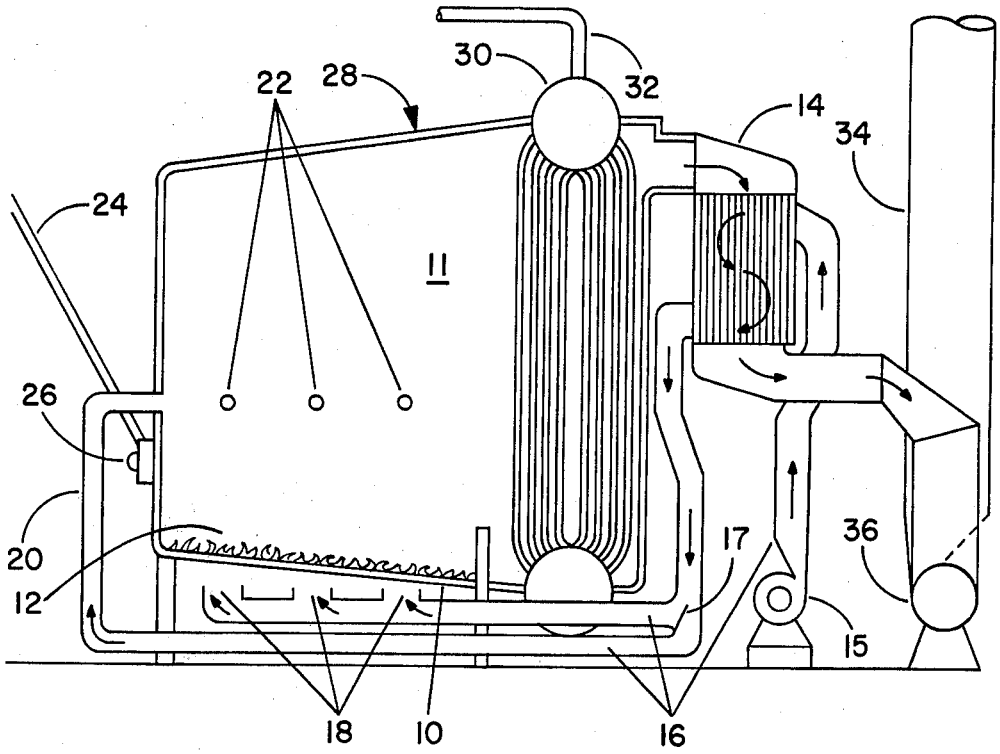
FIG. 1 is a diagrammatic view of a spreader-stoker boiler which can be utilized to perform the method of this invention.

The spreader-stoker furnace shown in FIG. 1 is a diagrammatic representation of a typical furnace of this type. This furnace 28 includes a porous grate 10 within chamber 11 on which a fuel bed 12 of wood residues is evenly distributed for combustion thereof. Combustion air which is heated by the combustion products of the furnace in a heat exchanger 14 is supplied by a fan and duct system 15 and 16, respectively, to the furnace. A portion of the air is supplied and distributed by valve 17 below grate 10 via duct outlets or vents 18 to provide the underfire portion of the combustion air. The remaining air is conducted via duct 20 to ports 22 in the walls of furnace chamber 11 to a location above the fuel bed to provide the overfire portion of the combustion air. The wood residue fuel is supplied through a chute 24 and a spreader 26 to the upper portion of grate 10 within combustion chamber 11 of the furnace 28. The heat energy produced by combustion of the fuel material in fuel bed 12 may be utilized to produce steam in a heat exchanger 30, which steam may be carried via conduit 32 to some appropriate utilization means. The heated combustion products may be passed through the heat exchanger 14 and emitted from a suitable stack 34 by fan 36.

The underfire air provided by vents 18 through grate 10 is used to provide sufficient oxygen to oxidize solid carbon in the fuel bed to carbon monoxide but insufficient to appreciably oxidize the same to carbon dixoide. As the fuel burns, the volatile portion of the fuel is carried away by the underfire air into the combustion chamber 11 along with the carbon monoxide. The overfire combustion air distributed in combustion chamber 11 by ports 22 is then used to complete combution of carbon monoxide to carbon dioxide and to burn the volatile portions distributed therethrough. It has been found that by providing approximately one pound of combustion air per pound of wood as underfire air with the remaining combustion air as overfire air (about 5½ pounds of air to about 12 pounds of air per pound of fuel) will achieve this combustion while reducing the gas velocities at grate 10 through fuel bed 12 and thus minimize the entrainment of char particles in the combustion air.

It is noted that means may be provided (not shown) to remove the ash products from above and below the grate. The fuel-layer depth may be monitored by any appropriate means such as by providing a window in the wall of the combustion chamber with an air supply to keep the window clear and by providing a depth indicator cooled by the underfire on the grate, such as by positioning a stainless steel or ceramic tube over one of the grate openings in the fuel bed. Electronic monitoring of fuel level using high frequency electro-magnetic radiation is also possible.

It has been found that the amount of char and ash carryover from the fuel bed 12 may be substantially reduced by providing a sufficiently thick layer of incandescent char to convert all oxygen admitted underfire to carbon monoxide and carbon dioxide. This allows the bed depth to be an effective indicator of the underfire air/fuel ratio. The fresh fuel is denser than the char and tends to hold down the char when less than fluidizing flows of underfire air are distributed through the fuel bed and the fuel particles also act as a filter.

Figure 2:
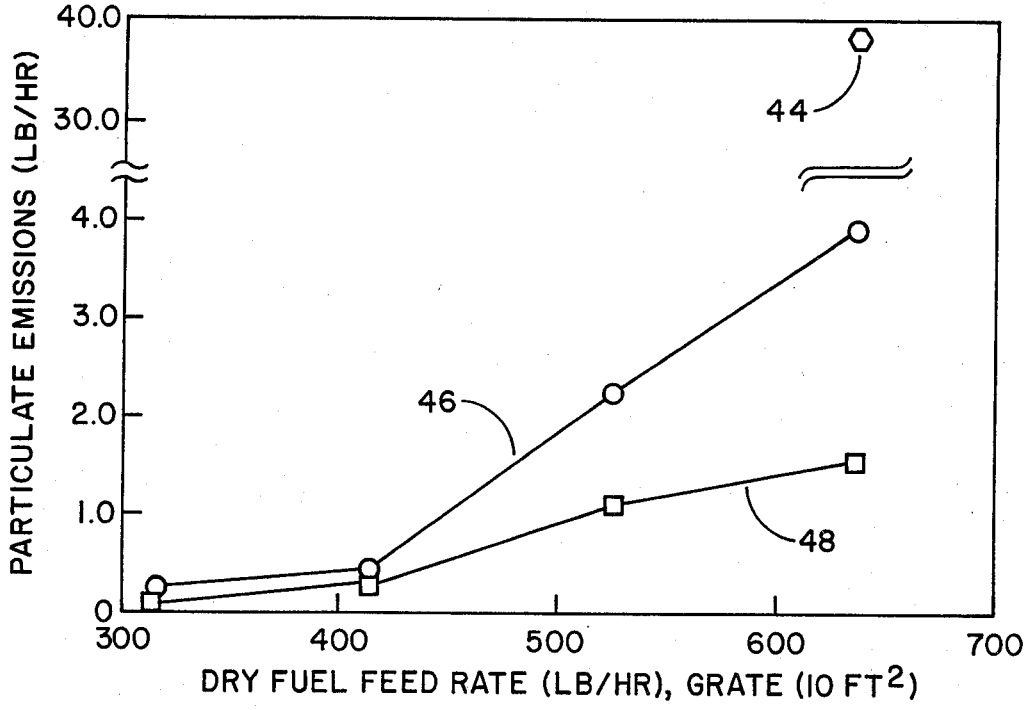
FIG. 2 is a graph showing the effect of different fuel bed depths on pounds per hour of particulate emission as the fuel feed rate is changed.
Figure 3:
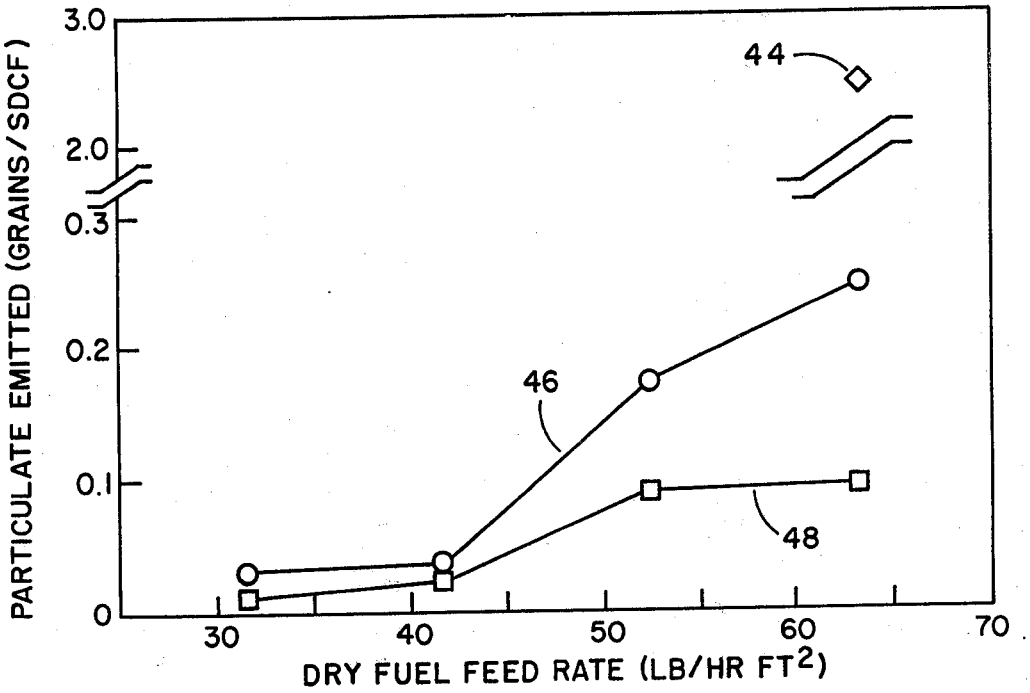
FIG. 3 is a graph showing the effect of different bed depths on grains per standard dry cubic foot of particulate emission as the fuel feed rate is changed.
Figure 4:
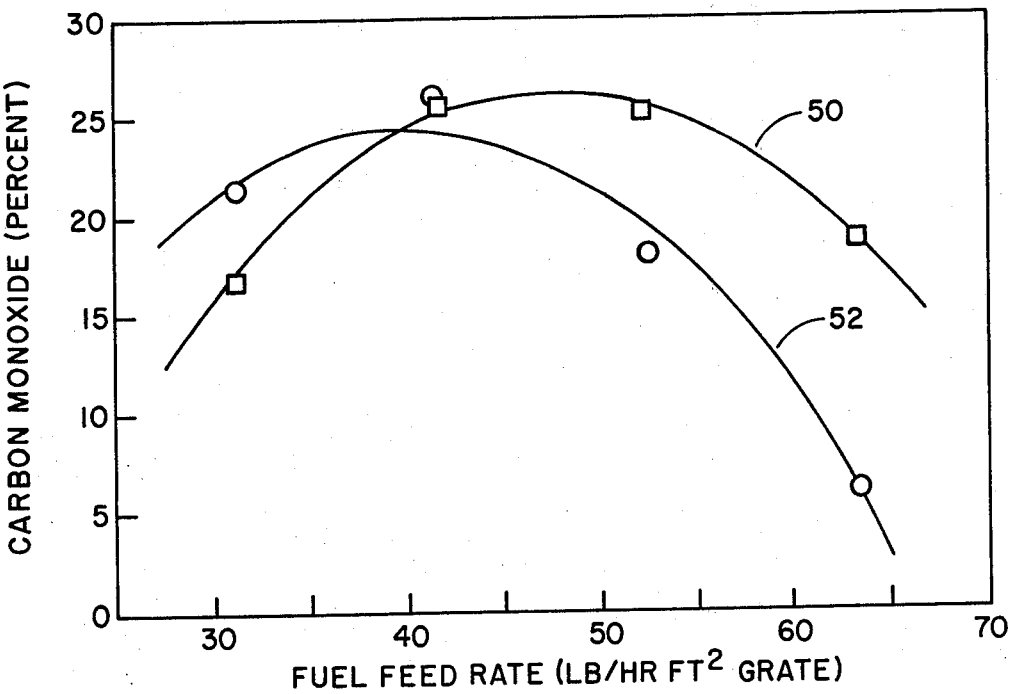
FIG. 4 is a graph of carbon monoxide produced in the fuel bed for different fuel bed depths as the fuel feed rate of the furnace is varied.

The data point 44 in FIGS. 2 and 3 were measured using a fuel bed 1 inch deep which represents prior operating conditions with 50 percent underfire air. The curves 46 in FIGS. 2 and 3 were measured using a 2 inch fuel bed while curves 48 represent a fuel bed 4 inches deep. It can be seen that as the bed depth increases, there is a substantial decrease (factor of 40) in particulate emission from a wood residue fired furnace. Measurements have also indicated that a wood residue fuel bed can be burned in a layer 6 inches thick in such a furnace arrangement with commensurate reductions in particulate emissions. It is noted that by increasing the fuel feed rate, an increase in the carryover rate of particulates occurs and that increasing the thickness of the fuel layer from 2 inches to 4 inches has the effect of reducing this carryover rate. The effect on particulate emissions of fuel layer thickness increases as the fuel feed rate is increased. The curve 50 for a 4-inch bed and a curve 52 for a 2-inch bed shown in FIG. 4 indicate that more carbon monoxide is produced in the 4-inch bed than the 2-inch bed. It is seen that a fuel bed several inches thick or more in a wood fired spreader-stoker furnace can be used to effectively meter the underfire air to reduce particulate emissions increase efficiency and increase the heating value of the gases produced in the fuel bed which become fuel for the overfire combustion. It is felt that a mininum thickness of 3 inches may provide the best results with a thicker layer being desirable if very high firing rates are used or if wood having greater than 50% moisture is distributed in the furnace. At a depth of greater than about 8 inches, the filtering effect may decrease and cease to exist.

What is claimed is:

1. A method for reducing particulate emissions from wood residue fuel combustion on a pinhole grate in a spreader-stoker furnace comprising:

evenly distributing wood residue fuel feed over a fuel bed on said grate, distributing an underfire portion of the combustion air equal to about one pound of air per pound of dry fuel to said fuel through said pinhole grate sufficient to convert the solid carbon in said fuel to carbon monoxide gas, distributing an overfire remainder of the combustion air equal to from about 5½ to 12 pounds of air per pound of air per pound of dry fuel above said fuel bed to complete combustion of said carbon monoxide gas and combustible volatile matter, and maintaining said fuel bed at a depth equal to from about 3 to 8 inches sufficient to convert said carbon to carbon monoxide and to entrap char particles inside said fuel bed by providing a continuous layer of fresh fuel over the surface of said fuel bed with the depth of the fuel bed indicating that the correct amount of air is being supplied underfire to minimize emissions and maximize efficiency.

* * * * *